US006453968B1

(12) United States Patent
Hsu

(10) Patent No.: US 6,453,968 B1
(45) Date of Patent: Sep. 24, 2002

(54) DISPENSING DEVICE FOR DOUBLE-FACE ADHESIVE TAPE

(76) Inventor: Tsang-Hung Hsu, 14 Floor, No. 632, Ta-Yu Road, Taoyuan City (TW), 330

( * ) Notice: Subject to any disclaimer, the term of this patent is extended or adjusted under 35 U.S.C. 154(b) by 91 days.

(21) Appl. No.: 09/677,337

(22) Filed: Sep. 28, 2000

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/574, 577, 156/579, 584, 523, 527, 540, 541; 118/76, 257; 242/160.2, 160.4, 170, 171, 588.2, 588.3, 588.6

(56) References Cited

U.S. PATENT DOCUMENTS 5,472,560 A * 12/1995 Horng ..... 156/523
5,954,916 A * 9/1999 Orlandi ..... 156/385
6,227,274 B1 * 5/2001 Koyama et al. ..... 118/257
6,273,982 B1 * 8/2001 Semmler ..... 118/257

* cited by examiner

*Primary Examiner*—Richard Crispino
*Assistant Examiner*—Cheryl N. Hawkins

(57) ABSTRACT

A dispensing device for double-face adhesive tape includes: a casing; a driving reel having a tape coil mounted thereon for dispensing a double-face adhesive tape outwardly; a follower reel rotatably coupled with said driving reel for recovering a releasing strip as separated from the adhesive tape as unwound from the driving reel and guided by a guiding stem; a pressing roller rotatably mounted on a front end portion of the casing for pressing and applying the double-face adhesive tape on an adhering surface; and a cutter fixed at a front end of the casing for cutting the adhesive tape at a desired length; characterized in that a rewinding mechanism is provided in the driving reel and the follower reel for rewinding a loosening tape for its tightening or for retracting the tape adhered on the releasing strip for peeling the adhesive tape to be well separated from the releasing paper.

5 Claims, 6 Drawing Sheets

DISPENSING DEVICE FOR DOUBLE-FACE ADHESIVE TAPE

BACKGROUND OF THE INVENTION

U.S. Pat. No. 4,851,076 to Christoph Manusch disclosed an adhesive film applicator for applying an adhesive film on a substrate surface. However, such an adhesive applicator is provided for applying the so-called "dry adhesive" coated on a tape or strip. The adhesive layer or film is directly transferred from the adhesive tape to the substrate surface. The adhesive film will be completely removed from the tape or strip and transferred to the substrate surface when pressing the applicator on the substrate surface. The adhesive film adheres to the substrate surface with a greater tenacity than to the tape and thus remains adherent to the substrate surface as the tape is drawn away from the substrate surface. Such an adhesive film is a thin adhesive layer without being carried on any substrate or base layer and is expensive in cost when compared with those double-face adhesive tapes having adhesive respectively coated on a surface layer and a bottom layer of a carrier strip.

The present inventor has found the drawbacks of the prior art of adhesive applicator and invented the dispensing device for applying double-face adhesive tape with cheaper cost.

SUMMARY OF THE INVENTION

The object of the present invention is to provide a dispensing device for double-face adhesive tape including: a casing; a driving reel having a tape coil mounted thereon for dispensing a double-face adhesive tape outwardly; a follower reel rotatably coupled with said driving reel for recovering a releasing strip as separated from the adhesive tape as unwound from the driving reel and guided by a guiding stem; a pressing roller rotatably mounted on a front end portion of the casing for pressing and applying the double-face adhesive tape on an adhering surface; and a cutter fixed at a front end of the casing for cutting the adhesive tape at a desired length; characterized in that a rewinding mechanism is provided in the driving reel and the follower reel for rewinding a loosening tape for its tightening or for retracting the tape adhered on the releasing strip for peeling the adhesive tape to be well separated from the releasing paper.

DETAILED DESCRIPTION

Figure 1:
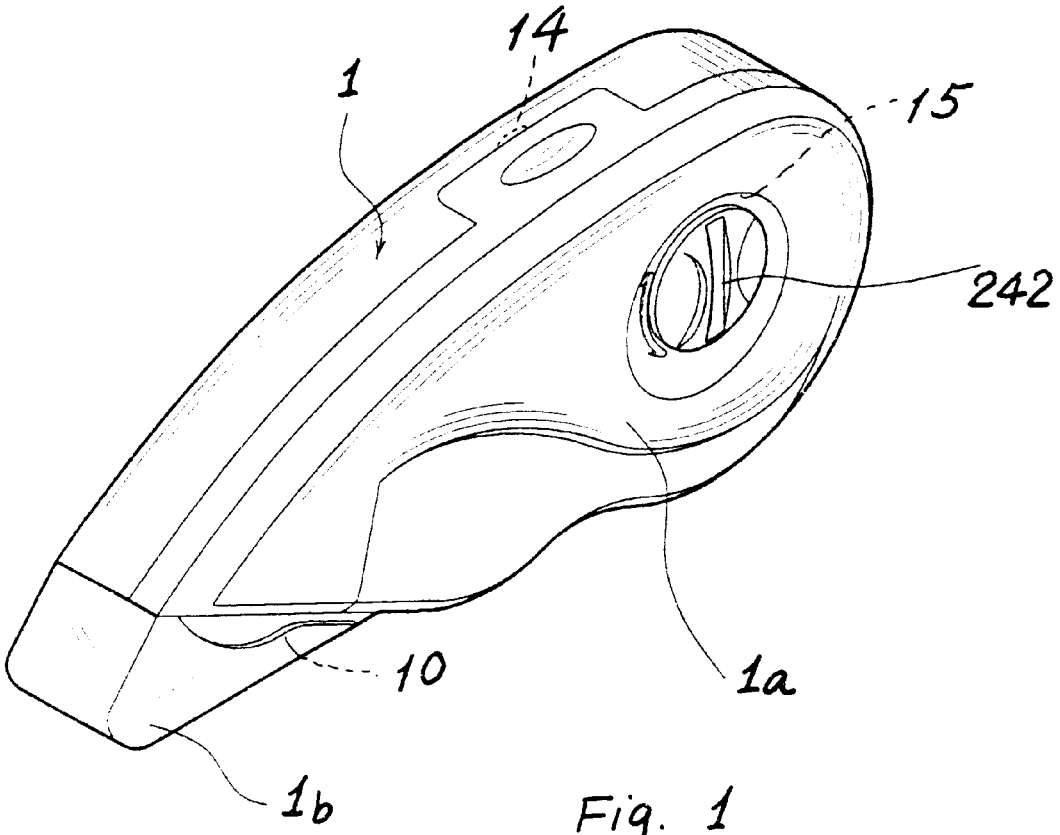
FIG. 1 is a perspective view of the present invention.

As shown in the drawing figures, the present invention comprises: a casing 1, a driving reel 2 rotatably mounted in the casing 1, a tape coil 3 mounted in (or rotatably loaded on) the driving reel 2, a follower reel 4 coupled with the driving reel 2, a guiding stem 5 formed in a front portion of the casing 1, a pressing roller 6 rotatably mounted on a shaft 61 formed in a front end portion of the casing, and a cutter 7 secured on a holder 71 formed on a front end of the casing 1.

The casing 1 includes: a cover 1*a* pivotally secured to the casing by a hinge including a pivot 12 formed on the cover 1*a* and a pivot socket 11 formed in the casing 1, a latch 14 formed on the cover 1*a* to be engageable with a latch recess 14 recessed in the casing 1 for locking the cover 1*a* to the casing 1, and a cap 1*b* encapping a front bottom opening 10 of the casing 1, through the opening 10 the adhesive tape of the present invention can be dispensed outwardly.

The driving reel 2 includes: a first axle 21 perpendicularly formed in the casing 1 defining a first axis X1 at a longitudinal center of the first axle 21, a driving wheel 22 rotatably mounted on the first axle 21, a ratchet ring 23 concentrically formed on the casing 1 about the first axle 21 allowing an unidirectional rotation (R1) of the driving reel 2 when dispensing the adhesive tape outwardly as unwound from the driving reel 2, and a first spool 24 coupled with the driving wheel 22 loaded thereon with the tape coil 3 consisting of a double-face adhesive tape 32 adhered with a releasing strip (or paper) 31 to be coaxially wound to form the tape coil 3.

Figure 2:
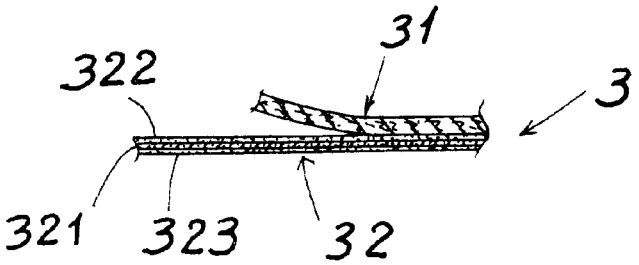
FIG. 2 is a partial sectional drawing of the adhesive tape and the releasing paper of the present invention.
Figure 3:
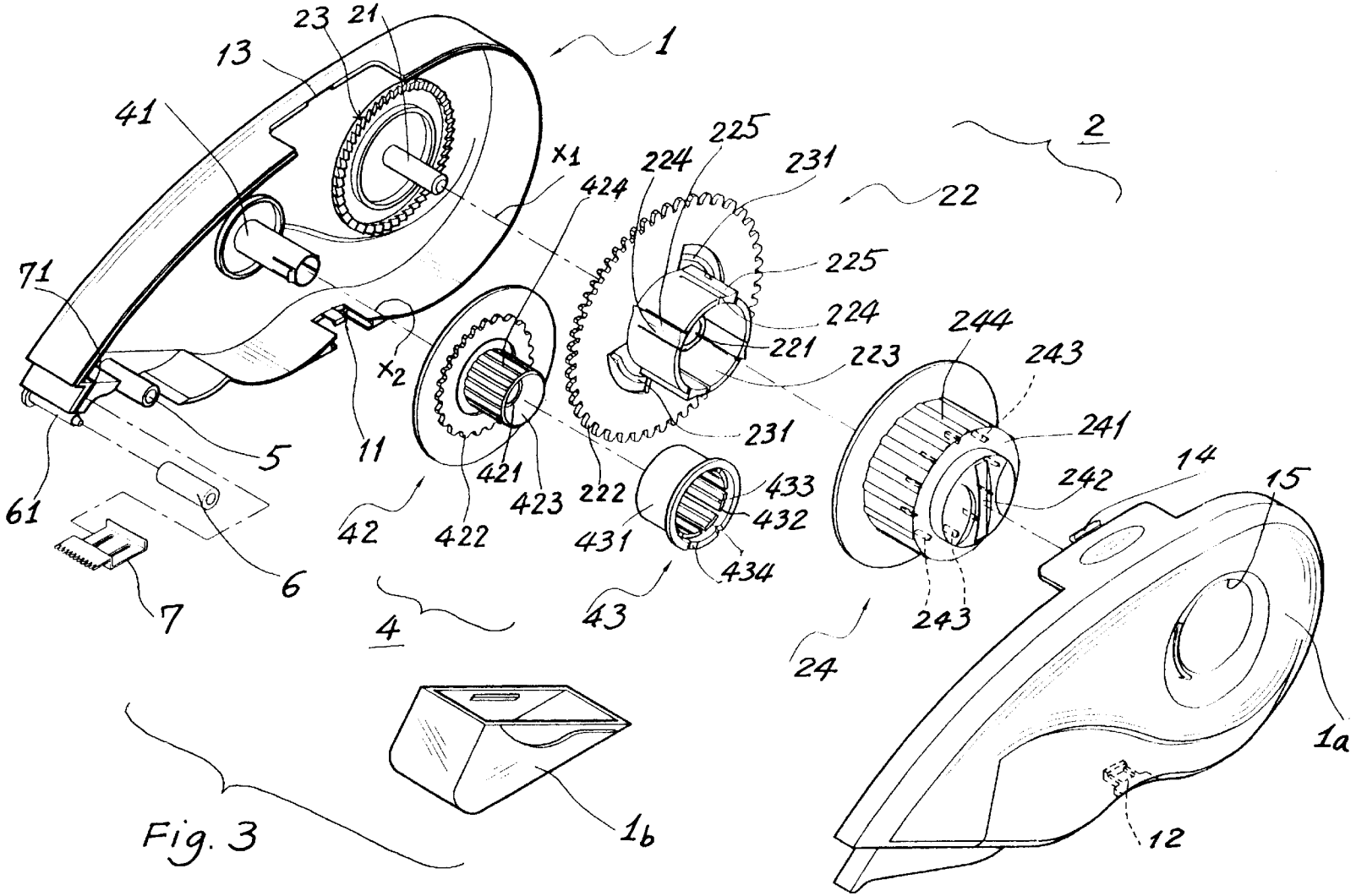
FIG. 3 is an exploded view showing the elements of the present invention.
Figure 4:
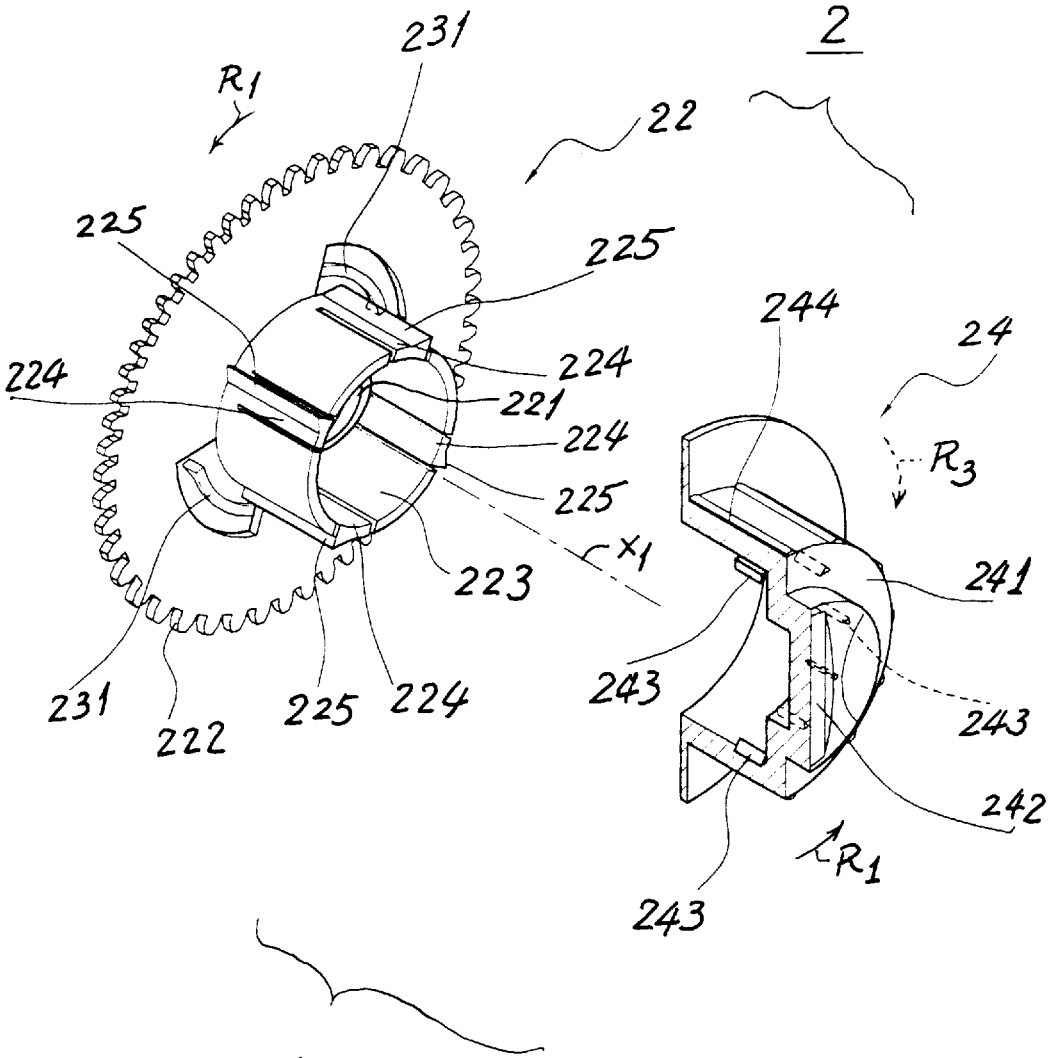
FIG. 4 is a perspective view of the driving reel of the present invention.
Figure 7:
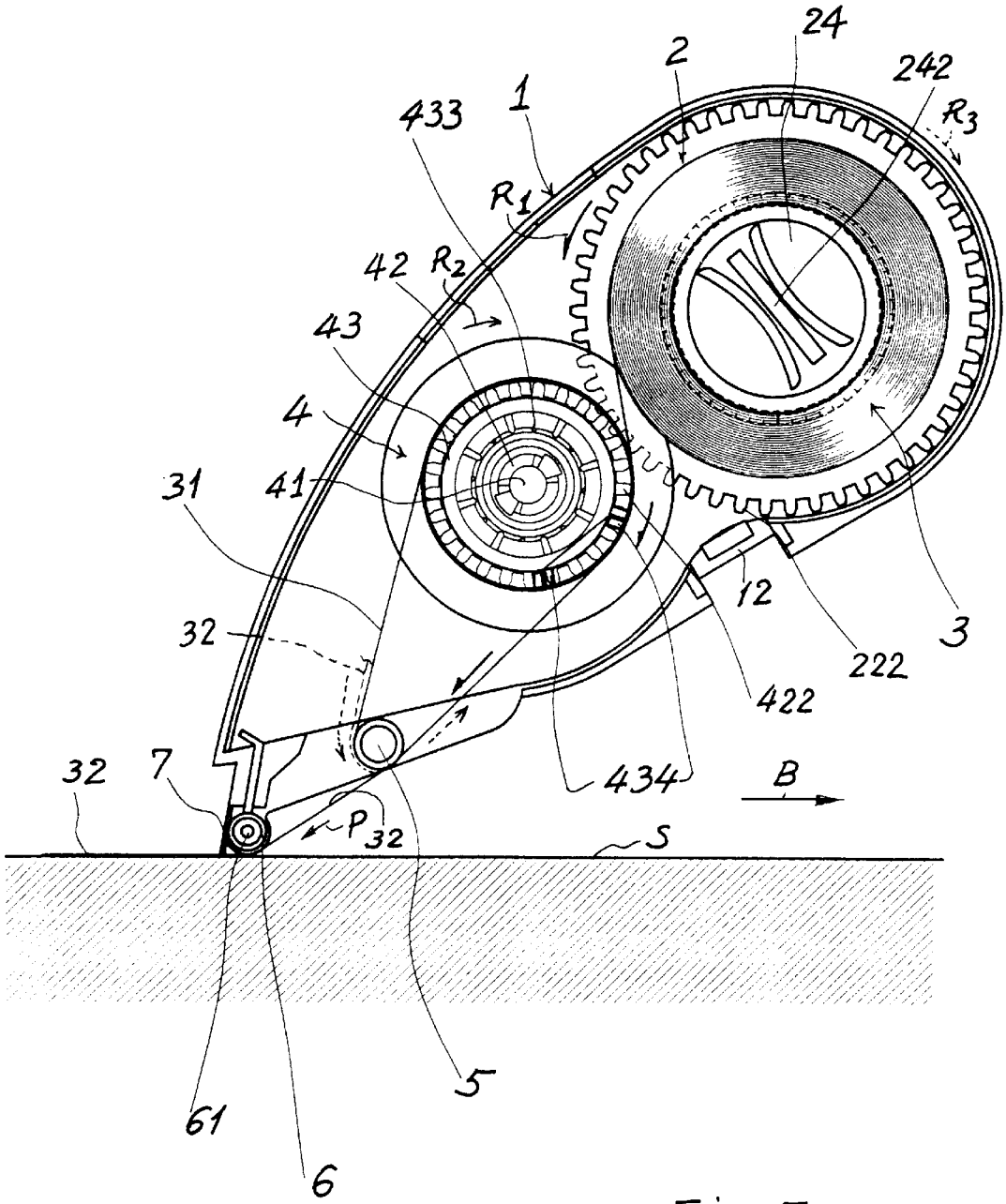
FIG. 7 shows the dispensing of adhesive tape when using the present invention.

The double-face adhesive tape 32 especially as shown in FIG. 2 includes: a carrier strip 321; a surface adhesive layer 322 formed on an upper surface of the carrier strip 321 as released (or peeled) from the releasing strip 31 to be adhered with an external object such as a label, an envelope, a photograph, and so on; and a bottom adhesive layer 323 formed on a bottom surface of the carrier strip 321 to be adhered on an adhering surface S as shown in FIG. 7, when pulling (P) the tape 32 outwardly by moving the dispensing device in a rearward or backward direction B.

Such a double-surface adhesive tape 32 includes a carrier strip 321 (preferably made of transparent film) sandwiched between the surface layer 322 and the bottom layer 323 and will be cheaper in cost than the adhesive film without carrier (substrate) strip backed below the adhesive film (which is, for example, disclosed in U.S. Pat. No. 4,851,076).

The driving wheel 22 of the driving reel 2 includes: a driving hub 221 rotatably engageable with the first axle 21, a driving gear 222 formed on a bottom portion of an inner cylinder 223 disposed around the driving hub 221, a plurality of resilient bars 224 circumferentially longitudinally formed on the inner cylinder 223 each resilient bar 224 parallel to the first axis X1 and a ratchet key 225 formed on each resilient bar 224.

The driving wheel 22 further includes a plurality of resilient pawls 231 circumferentially formed on a lower portion of the driving wheel 22 to be rotatably slipping from the ratchet ring 23 formed on the casing 1 to ensure a forward rotation (R1) when pulling (P) the adhesive tape 32 from the tape coil 3 as unwound from the first spool 24 when applying the adhesive tape 32 by pressing the tape 32 on an adhering surface 3 when backwardly moving (B) the dispensing device of the present invention as shown in FIG. 7, while preventing a reversing rotation (opposite to the forward rotation R1) since each pawl 231 will be retarded against the ratchet teeth on the ratchet ring 23.

The first spool 24 includes: an outer cylinder 241 engageable with the inner cylinder 223 of the driving wheel 22, a knob 242 formed on an outer portion of the outer cylinder 241 and protruding outwardly through a knob hole 15 formed in the cover 1*a* of the casing 1 for rotating the knob 242 for reversing the first spool 24 when rewinding the tape, a plurality of inner ribs 243 juxtapositionally longitudinally formed in an inside wall of the outer cylinder 241 with each inner rib 243 engageable with each ratchet key 225 on each resilient bar 224 for a synchronous rotation of the first spool 24 and the driving wheel 22 when rotating the driving reel 2 in a forward direction R1 for outwardly dispensing the adhesive tape 32 as unwound from the driving reel 2; whereby upon a reversing rotation R3 of the first spool 24 as shown in dotted line of FIG. 7, each inner rib 243 on the first spool 24 will be slipped away from each ratchet key 225 on the driving wheel 22 allowing a reversing rotation of the first spool 24 in a reverse direction R3 as shown in dotted line of FIG. 7 for rewinding the adhesive tape 32 and the releasing strip 31 of the tape coil 3 for tightening the tape for preventing loosening thereof and also for retracting the adhesive tape 32 as adhered on the releasing strip 31 as accidentally "fed" to the follower reel 4 as dotted line shown in FIG. 7 for a maintenance work such as for separating the adhesive tape 32 from the releasing strip 31, and a plurality of outer ribs 244 longitudinally circumferentially formed on the outer cylinder 241 for frictionally firmly holding the tape coil 3 on the first spool 24.

The follower reel 4 includes: a second axle 41 perpendicularly formed in the casing 1 adjacent to the first axle 21 defining a second axis X2 at a longitudinal center of the second axle 41, a follower wheel 42 rotatably mounted on the second axle 42, a second spool 43 coupled with the follower wheel 42 for recovering and winding the releasing strip 31 as separated from the double-face adhesive tape 32 as unwound from the driving reel 2 when outwardly dispensing the adhesive tape of the present invention.

The follower wheel 42 of the follower reel 4 includes: a follower hub 421 rotatably engageable with the second axle 41, a follower gear 422 formed on a bottom portion of an inner sleeve 423 disposed around the follower hub 421 and engageable with the driving gear 222, and a plurality of grooves 424 circumferentially longitudinally recessed in an outer surface of the inner sleeve 423 each groove 424 parallel to the second axis X2.

Figure 5:
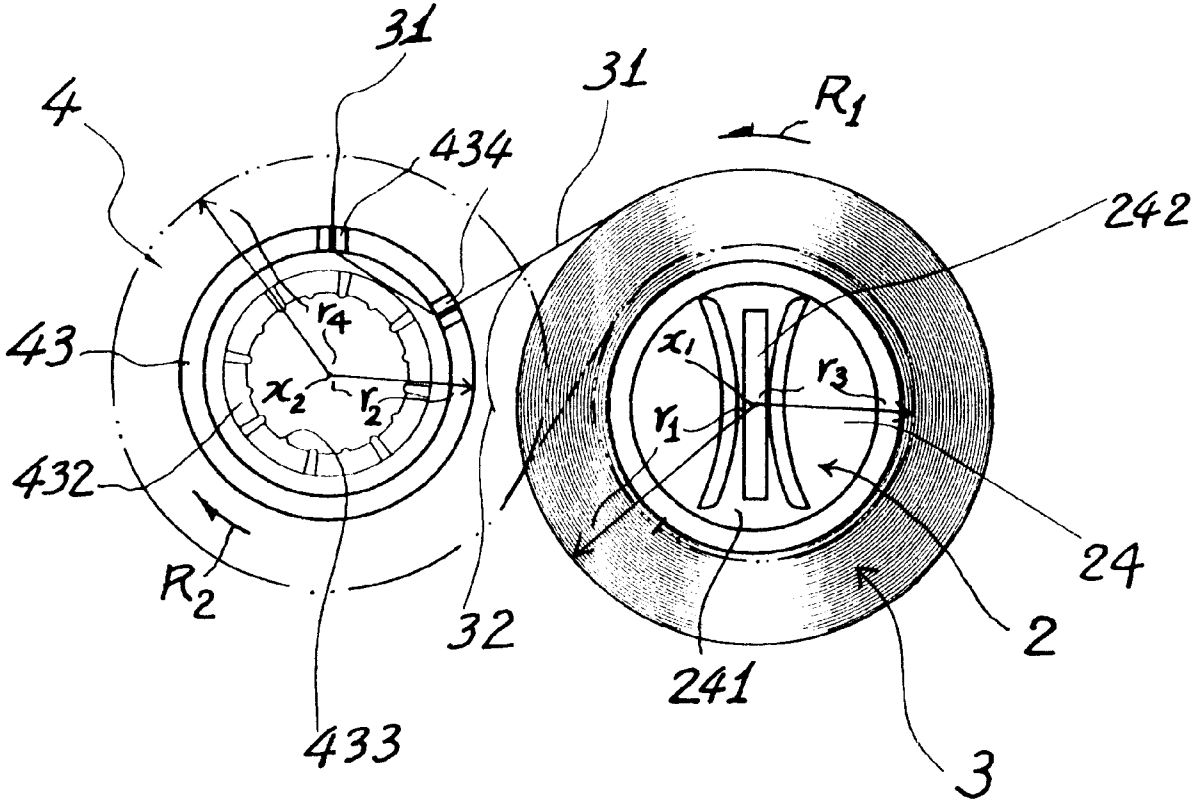
FIG. 5 is an illustration showing the relationship between the driving reel and the follower reel of the present invention.
Figure 6:
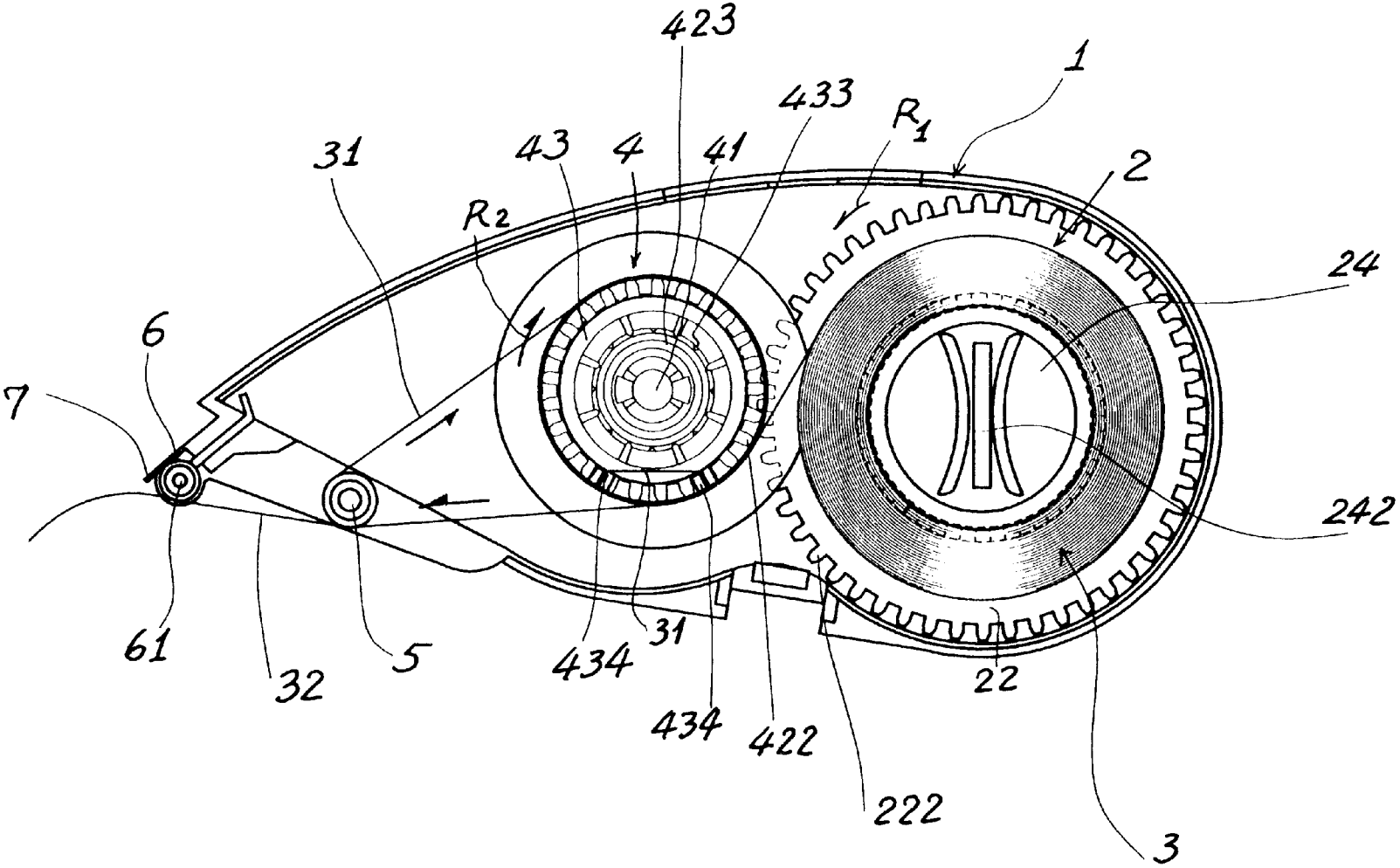
FIG. 6 is an illustration showing the assembly of the present invention.

The second spool 43 includes: an outer sleeve 431, a plurality of resilient plates 432 circumferentially annularly formed on a central portion of the outer sleeve 431 to be engageable with the inner sleeve 423 of the follower wheel 42, a plurality of longitudinal ribs 433 each longitudinally formed on an inside surface of each resilient plate 432 to be normally engageable with each groove 424 in the inner sleeve 423, and at least a slit 434 notched in the outer sleeve 431 for inserting a portion of the releasing strip 31 as shown in FIG. 5 when initially fixing the releasing strip 31 on the follower reel 4 for recovering the releasing strip 31 when releasing the adhesive tape 32.

The longitudinal ribs 433 of the second spool 43 are normally engageable with the grooves 424 of the follower wheel 42 for a synchronous rotation when the follower wheel 42 is driven by the driving wheel 22 when pulling and dispensing the adhesive tape 32 outwardly for recovering and winding the releasing strip 31 when removed from the adhesive tape 32 on the second spool 43. When rewinding the tape backward to the driving reel 2, the ribs 433 may be uncoupled and slipped from the grooves 424.

As shown in FIG. 5 (from solid line to dotted line) and when the releasing strip 31 is taken up by the follower reel 4 as the tape coil 3 unwound from the driving reel 2, the strip 31 will be continuously wound on the second spool 43 to increase the diameter from $r_2$ to $r_4$, while the diameter of the tape 3 on the first spool 24 is decreased from $r_1$ to $r_3$, whereby the distance or length of the strip 31 as wound on the second spool 43 will be obtained as:

$$r/t \times 2\pi r4$$

wherein r/t is a rotation speed (such as revolutions r of the follower reel 4 per time period t), which is greater than that of the original or earlier one obtained as:

$$r/t \times 2\pi r2 \text{ (since } r4 > r2)$$

By designating the rotation speed of the driving reel 2 as R/t, the length of the tape as unwound from the driving reel 2 is obtained as:

$$R/t \times 2\pi r3$$

which is decreased from the original $$R/t \times 2\pi r1 \text{ (since } r1 > r3).$$

The gear ratio between the driving reel 2 and the follower reel 4 is unchanged. However, the diameter of the strip 31 at the follower reel 4 is increased as above-mentioned so that the greater increase of the winding length at the follower reel 4 can not be enough supplied by the unwinding length at the driving reel 2, thereby dogging the coupling rotation of the second spool 43. The continuous pulling (P) of the adhesive tape outwardly will drive the driving reel 2 to allow the driving gear 222 to drive the follower gear 422 of the follower reel 4 to cause the following rotation of the follower wheel 42 and the grooves 424 on the follower wheel 42 will be slipped away from the ribs 433 on the second spool 43. After the tape 3 is unwound from the driving reel 2 to be enough taken up by the second spool 43, the releasing strip 31 will then be continuously wound on the second spool 43. Therefore, the ribs 433 on the second spool 43 are normally engaged with the grooves 424 on the follower wheel 42 for a synchronous rotation of the spool 43 with the wheel 42 for taking up the releasing strip 31 from the adhesive tape 32. When the second spool 43 is dogged as the tape tensioned between the two spools 43, 24, the following rotation of the follower wheel 42 (as driven by the driving wheel 22) will be slipped away and uncoupled from the second spool 43 since the ribs 433 on the spool 43 will be slipped from the grooves 424 on the wheel 42.

Accordingly, the present invention provides a rewinding mechanism so as to retract the adhesive tape 32 if still adhered on the releasing strip 31 and accidentally fed to the second spool 43 (dotted line shown in FIG. 7) for checking, maintenance, and well peeling of the adhesive tape 32 from the releasing strip 31. The adhesive tape 32 has its bottom layer 323 adhered on the surface S and has its surface layer 322 provided ready for adhesion with any object when the tape 32 is pressed against the surface S as rotatably pressed by the roller 6 when pulling the casing 1 backward B (FIG. 7). At a desired length, the tape 32 may be severed by the cutter 7 provided on a front end of the casing. The guiding stem 5 formed on a front portion of the casing 1 will help guide the releasing strip 31 as separated from the tape 32.

The present invention may be modified without departing from the spirit and scope of the present invention.

I claim:

1. A dispensing device for dispensing double-face adhesive tape comprising: a casing; a driving reel rotatably loaded with a tape coil consisting of a releasing strip and a double-face adhesive tape detachably adhered on said releasing strip for dispensing said double-face adhesive tape outwardly; a follower reel rotatably coupled with said driving reel for recovering said releasing strip as separated from the adhesive tape as unwound from the driving reel and guided by a guiding stem formed on a front portion in said casing; a pressing roller rotatably mounted on a front end portion of the casing for pressing and applying the double-face adhesive tape on an adhering surface; and a cutter fixed at a front end of the casing for cutting the adhesive tape at a desired length; and a rewinding means formed in the driving reel and the follower reel for rewinding said adhesive tape and said releasing strip for tightening thereof and for retracting the adhesive tape already adhered with the releasing strip for a well separation of the adhesive tape from the releasing strip;

said driving reel including: a first axle perpendicularly formed in the casing defining a first axis at a longitudinal center of the first axle, a driving wheel rotatably mounted on the first axle, a ratchet ring concentrically formed on the casing about the first axle allowing an unidirectional rotation of the driving reel when dispensing the adhesive tape outwardly as unwound from the driving reel, and a first spool coupled with the driving wheel and loaded thereon with the tape coil consisting of said double-face adhesive tape adhered with said releasing strip coaxially wound to form the tape coil;

the improvement which comprises:

said driving wheel including: a driving hub rotatably engageable with the first axle, a driving gear formed on a bottom portion of an inner cylinder disposed around the driving hub, a plurality of resilient bars circumferentially longitudinally formed on the inner cylinder each said resilient bar parallel to the first axis and a ratchet key formed on each said resilient bar; and said first spool including: an outer cylinder engageable with the inner cylinder of the driving wheel, a knob formed on an outer portion of the outer cylinder and protruding outwardly through a knob hole formed in a cover of the casing for rotating the knob for reversing the first spool, a plurality of inner ribs juxtapositionally longitudinally formed in an inside wall of the outer cylinder with each said inner rib engageable with a ratchet key formed on each said resilient bar for a synchronous rotation of the first spool and the driving wheel when rotating the driving reel in a forward direction for outwardly dispensing the adhesive tape as unwound from the driving reel; whereby upon a reversing rotation of the first spool, each said inner rib on the first spool will be slipped away from each said ratchet key on the driving wheel allowing a reversing rotation of the first spool in a reverse direction for rewinding the adhesive tape and the releasing strip of the tape coil for tightening the tape for preventing loosening thereof and for retracting the adhesive tape as adhered on the releasing strip as accidentally fed to the follower reel for maintenance of the adhesive tape and the releasing strip, and a plurality of outer ribs longitudinally circumferentially formed on the outer cylinder for frictionally firmly holding the tape coil on the first spool.

2. A dispensing device according to claim 1, wherein said driving wheel further includes a plurality of resilient pawls circumferentially formed on a lower portion of the driving wheel to be rotatably slipping from the ratchet ring formed on the casing to ensure a forward rotation when pulling the adhesive tape from the tape coil as unwound from the first spool when applying the adhesive tape by pressing the adhesive tape on an adhering surface when backwardly moving the dispensing device.

3. A dispensing device according to claim 1, wherein said follower reel includes: a second axle perpendicularly formed in the casing defining a second axis at a longitudinal center of the second axle, a follower wheel rotatably mounted on the second axle, a second spool coupled with the follower wheel for recovering and winding the releasing strip as separated from the double-face adhesive tape as unwound from the driving reel when outwardly dispensing the adhesive tape.

4. A dispensing device according to claim 3, wherein said follower wheel includes: a follower hub rotatably engageable with the second axle, a follower gear formed on a bottom portion of an inner sleeve disposed around the follower hub and coupled with a driving gear of said driving reel, and a plurality of grooves circumferentially longitudinally recessed in an outer surface of the inner sleeve each said groove parallel to the second axis and engageable with said second spool.

5. A dispensing device according to claim 4, wherein said second spool includes: an outer sleeve, a plurality of resilient plates circumferentially annularly formed on a central portion of the outer sleeve to be engageable with the inner sleeve of the follower wheel, a plurality of longitudinal ribs each longitudinally formed on an inside surface of each said resilient plate to-be normally engageable with each said groove in the inner sleeve, and at least a slit notched in the outer sleeve for inserting therein a portion of a releasing strip as separated from an adhesive tape; said longitudinal ribs of the second spool normally engageable with the grooves of the follower wheel for a synchronous rotation when the follower wheel is driven by the driving wheel when pulling and dispensing the adhesive tape outwardly for recovering and winding the releasing strip on said second spool; whereby upon a rewinding of said releasing strip and said adhesive tape to said driving reel, said ribs on said second spool are slipped away from said grooves on said follower wheel, allowing a reversing rotation of said second spool.

* * * * *